US009695495B2

(12) United States Patent
Zhao et al.

(10) Patent No.: US 9,695,495 B2
(45) Date of Patent: Jul. 4, 2017

(54) PROCESS FOR PRODUCING AN ALUMINUM ALLOY SHEET FOR MOTOR VEHICLE

(71) Applicant: NIPPON LIGHT METAL CO., LTD., Tokyo (JP)

(72) Inventors: Pizhi Zhao, Shizuoka (JP); Toshiya Anami, Shizuoka (JP); Kazumitsu Mizushima, Aichi (JP); Akira Goto, Saitama (JP); Hitoshi Kazama, Saitama (JP); Kunihiro Yasunaga, Saitama (JP)

(73) Assignee: NIPPON LIGHT METAL CO., LTD. (JP)

( * ) Notice: Subject to any disclaimer, the term of this patent is extended or adjusted under 35 U.S.C. 154(b) by 260 days.

(21) Appl. No.: 14/584,317

(22) Filed: Dec. 29, 2014

(65) Prior Publication Data

US 2015/0114523 A1 Apr. 30, 2015

Related U.S. Application Data

(62) Division of application No. 12/746,127, filed as application No. PCT/JP2008/000161 on Feb. 6, 2008, now abandoned.

(51) Int. Cl.

| | |
|---|---|
| ***B22D 11/06*** | (2006.01) |
| ***C22F 1/047*** | (2006.01) |
| ***B22D 11/124*** | (2006.01) |
| ***C22C 21/06*** | (2006.01) |
| ***C22F 1/04*** | (2006.01) |
| ***C22C 21/08*** | (2006.01) |
| *B21B 1/22* | (2006.01) |
| *B21B 3/00* | (2006.01) |
| *B21B 27/00* | (2006.01) |

(52) U.S. Cl.

CPC ..... *C22F 1/047* (2013.01); *B22D 11/0605* (2013.01); *B22D 11/124* (2013.01); *C22C 21/06* (2013.01); *C22C 21/08* (2013.01); *C22F 1/04* (2013.01); *B21B 1/22* (2013.01); *B21B 3/00* (2013.01); *B21B 27/005* (2013.01); *B21B 2003/001* (2013.01)

(58) Field of Classification Search

CPC ... C22F 1/047; B22D 11/0605; B22D 11/124; C22C 21/08

See application file for complete search history.

(56) References Cited

U.S. PATENT DOCUMENTS

| | | | |
|---|---|---|---|
| 6,248,193 | B1 | 6/2001 | Zhao et al. |
| 6,369,347 | B1 | 4/2002 | Zhao et al. |
| 2003/0164208 | A1 | 9/2003 | Yasunaga et al. |
| 2009/0007994 | A1 | 1/2009 | Zhao et al. |

FOREIGN PATENT DOCUMENTS

| | | | | |
|---|---|---|---|---|
| CN | 1269844 | A | 10/2000 | |
| CN | 101072888 | A | 11/2011 | |
| JP | 5320809 | A | 12/1993 | |
| JP | 11080913 | | 3/1999 | |
| JP | 3155678 | | 4/2001 | |
| JP | 2001262263 | A | 9/2001 | |
| JP | 2004076155 | A | 3/2004 | |
| JP | 2007-186741 | A | 7/2007 | |
| JP | 2007186741 | A | 7/2007 | |
| JP | WO 2008010352 | A1 * | 1/2008 | ..... B22D 11/003 |
| WO | 2006011242 | A1 | 2/2006 | |

OTHER PUBLICATIONS

International Search Report for PCT/JP2008/000161 dated Apr. 28, 2008.

Extended International Search Report for PCT/JP2008/000161 dated Jul. 21, 2011.

"International Alloy Designations and Chemical Composition Limits for Wrought Aluminum and Wrought Aluminum Alloys", The Aluminum Association, Apr. 2004, pp. 7, 13.

"Effect of Thermomechanical Treatment on the Evolution of Rolling and Recrystallization Textures in Twin-Belt Cast AA5754 Aluminum Alloy", HN Azari et al., Metallurgical and Materials Transactions, Jun. 2004; 34A, pp. 1839-1851.

* cited by examiner

*Primary Examiner* — Roy King
*Assistant Examiner* — Janelle Morillo
(74) *Attorney, Agent, or Firm* — Heslin Rothenberg Farley & Mesiti, P.C.

(57) ABSTRACT

An aluminum alloy sheet for motor vehicles is produced by casting a melt, containing 3.0-3.5 mass % Mg, 0.05-0.3 mass % Fe, 0.05-0.15 mass % Si, and less than 0.1 mass % Mn, a balance substantially being inevitable impurities and Al, into a slab having a thickness of 5 to 15 mm in a twin-belt caster so that cooling rate at ¼ depth of thickness of the slab is 20 to 200° C./sec; winding the cast thin slab into a coiled thin slab subjected to cold rolling with a roll having a surface roughness of 0.2 to 0.7 μm Ra at a cold rolling reduction of 50 to 98%; subjecting the cold rolled sheet to final annealing either continuously in a CAL at a holding temperature of 400 to 520° C. within 5 minutes or in a batch annealing furnace at a holding temperature of 300 to 400° C. for 1 to 8 hours; and subjecting the resulting sheet to straightening with a leveler.

4 Claims, No Drawings

PROCESS FOR PRODUCING AN ALUMINUM ALLOY SHEET FOR MOTOR VEHICLE

CROSS REFERENCE TO RELATED APPLICATIONS

This application is a division of U.S. Application No. 12/746,127 filed on Aug. 20, 2010 which is the U.S. national phase filing of PCT Application No. PCT/JP2008/000161 filed on Feb. 6, 2008 and published in Japanese as WO 2009/098732 on Aug. 13, 2009, the entire disclosure of these applications being hereby incorporated by reference herein.

TECHNICAL FIELD

The present invention relates to an aluminum alloy sheet for motor vehicles and a process for producing the same, particularly to an aluminum alloy sheet suitable for forming a body sheet for motor vehicles and the like and a method for producing the same.

BACKGROUND ART

Heretofore, cold rolled steel sheets have been mainly used, for example, for automobile outer panels. However, in accordance with the requirements for weight reduction of automobile bodies, the use of aluminum alloy sheets such as an Al—Mg-based alloy sheet and an Al—Mg—Si-based alloy sheet has been studied recently. Particularly, the Al—Mg-based alloy sheet has been proposed as a body sheet for motor vehicles because it is excellent in strength, formability and corrosion resistance.

Heretofore, as a process for producing such an aluminum alloy sheet, there has been employed a process including casting a slab by DC casting, face milling both surfaces of the slab, homogenizing the face-milled slab in a soaking furnace, and subjecting the homogenized face-milled slab to hot rolling, cold rolling, intermediate annealing, cold rolling, and final annealing to finish it to a predetermined sheet thickness (refer to Patent Document 1).

On the other hand, there has been proposed a process including continuously casting a thin slab with a belt caster, directly winding the resulting thin slab into a coil, subjecting the coiled thin slab to cold rolling and final annealing to finish it to a predetermined sheet thickness. For example, there is disclosed a process for producing an aluminum alloy sheet for motor vehicles excellent in press formability and stress corrosion cracking resistance (Patent Document 2). This process comprises preparing a melt comprising 3.3-3.5 wt. % Mg and 0.1-0.2 wt. % Mn and further comprising at least one of 0.3 wt. % or less Fe and 0.15 wt. % or less Si, a balance being ordinary impurities and Al; casting the melt into a thin slab having a thickness of 5 to 10 mm in a twin-belt caster at a speed of 5 to 15 m/min so that the cooling rate at ¼ depth of the thickness of the thin slab is 40 to 90° C./sec; winding the resulting thin slab into a roll; cold rolling the rolled thin slab with a roll having a surface roughness of 0.2 to 0.7 μm Ra; and annealing the cold rolled thin sheet.

However, in the above process, since 0.1-0.2 wt. % Mn is contained in the chemical composition of the melt for the purpose of refining the recrystallized grains and the solidification cooling rate is relatively fast, the size of intermetallic compounds such as Al—(Fe.Mn)—Si is reduced to resulting in excellent formability. On the other hand, there is a problem that, since the amount of dissolved Mn in the matrix is excessively high, yield strength is higher and spring back after forming is increased.

In order to solve this problem, for example, a so-called stabilization treatment is proposed (Patent Document 3) in which a continuously cast and rolled sheet of an aluminum alloy containing 3-6 wt. % Mg is subjected to annealing treatment followed by straightening, heated at a predetermined temperature of 240 to 340° C. for 1 hour or more, and then slowly cooled.

Patent Document 1: Japanese Patent No. 3155678

Patent Document 2: International Publication No. WO 2006/011242

Patent Document 3: Japanese Patent Laid-Open No. 11-80913

DISCLOSURE OF THE INVENTION

In order to solve the problems as described above, the present invention has employed a process for producing an aluminum alloy sheet for motor vehicles excellent in press formability, resistance to surface roughening and shape fixability, the process comprising: casting a melt, comprising 3.0-3.5 mass % Mg, 0.05-0.3 mass % Fe, 0.05-0.15 mass % Si, and further a limited amount of less than 0.1 mass % Mn, a balance substantially being inevitable impurities and Al, into a thin slab having a thickness of 5 to 15 mm in a twin-belt caster so that the cooling rate at ¼ depth of the thickness of the thin slab is 20 to 200° C./sec; winding the cast thin slab into a coil; subjecting the coiled thin slab to cold rolling with a roll having a surface roughness of 0.2 to 0.7 μm Ra at a cold rolling reduction of 50 to 98%; subjecting the cold rolled thin sheet to final annealing continuously in a CAL at a holding temperature of 400 to 520° C.; and then subjecting the resulting sheet to straightening with a leveler. Alternatively, the cold rolled thin sheet may be subjected to final annealing in a batch annealing furnace at a holding temperature of 300 to 400° C.

Employing such a production process has made it possible to provide an aluminum alloy sheet for motor vehicles excellent in press formability, resistance to surface roughening and shape fixability, the sheet comprising 3.0-3.5 mass % Mg, 0.05-0.3 mass % Fe, 0.05-0.15 mass % Si, and further a limited amount of less than 0.1 mass % Mn, a balance substantially being inevitable impurities and Al, wherein the sheet has an intermetallic compound maximum size of 5 μm or less by circle-equivalent diameter in a region at ¼ depth of the sheet thickness, an average recrystallized grain size of 15 μm or less, a surface roughness of 0.2-0.6 μm Ra, a yield strength of 145 MPa or less, and a tensile strength of 225 MPa or more.

According to the present invention, an Al—Mg-based alloy sheet excellent in formability and shape fixability can be produced without subjecting a continuous cast and rolled sheet to stabilization treatment.

Best Mode For Carrying Out The Invention

The reasons why the chemical composition of the alloy has been limited in the present invention will be described below. Herein, "%" indicating chemical composition means "% by mass", unless otherwise specified.

[3.0-3.5% Mg]

Mg is an element which increases strength by solid solution strengthening effect. If the Mg content is less than 3.0%, this effect cannot be exhibited, and tensile strength will be reduced. If the Mg content exceeds 3.5%, yield strength will be excessively high to result in reduction of shape fixability.

[0.05-0.3% Fe]

Fe is crystallized as fine grains of intermetallic compounds such as an Al—Fe—Si-based compound during casting and functions as a nucleation site of recrystallization during annealing after cold rolling. Therefore, the number of recrystallized nuclei to be produced will be increased with an increase in the number of grains of these intermetallic compounds, resulting in formation of a large number of fine recrystallized grains. Moreover, the fine grains of the intermetallic compounds have an effect of pinning the grain boundaries of produced recrystallized grains to suppress the growth of crystal grains by the coalescence thereof to stably maintain the fine recrystallized grains. For exhibiting this effect, the Fe content needs to be 0.05% or more. However, if the Fe content exceeds 0.3%, the intermetallic compounds crystallized tend to be coarser, which leads to formation of voids with these intermetallic compounds as starting point during forming, resulting in inferior formability. Therefore, the Fe content is limited to 0.05 to 0.3%. A preferred range is from 0.05 to 0.25%.

[0.05-0.15% Si]

Si is crystallized as fine grains of intermetallic compounds such as an Al—Fe—Si-based compound during casting and functions as a nucleation site of recrystallization during annealing after cold rolling. Therefore, the number of recrystallized nuclei to be produced will be increased with an increase in the number of grains of these intermetallic compounds, resulting in formation of a large number of fine recrystallized grains. Moreover, the fine grains of the intermetallic compounds have an effect of pinning the grain boundaries of produced recrystallized grains to suppress the growth of crystal grains by the coalescence thereof to stably maintain the fine recrystallized grains. For exhibiting this effect, the Si content needs to be 0.05% or more. However, if the Si content exceeds 0.15%, the intermetallic compounds crystallized tend to be coarser, which leads to formation of voids with these intermetallic compounds as starting point during forming, resulting in inferior formability. Therefore, the Si content is limited to 0.05 to 0.15%. A preferred range is from 0.05 to 0.1%.

[Less than 0.1% Mn]

When Mn content is 0.1% or more, the solidification cooling rate during casting is high. This high solidification cooling rate increases the amount of dissolved Mn in the matrix, which excessively increases the yield strength of the final sheet to result in the reduction of shape fixability. Further, the Mn content is preferably limited to less than 0.08%, more preferably to less than 0.06%.

[0.001-0.1% Ti as an Optional Component]

In the present invention, Ti is preferably contained in the range of 0.001 to 0.1% for refining crystal grains of an ingot. For exhibiting this effect, the Ti content needs to be 0.001% or more. However, if the Ti content exceeds 0.1%, coarse intermetallic compounds such as $TiAl_3$ will be produced, leading to formation of voids during forming, which reduces formability. A more preferred range of the Ti content is from 0.001 to 0.05%. Ti may be added as a master alloy such as Al-10%Ti or may be added as a grain-refining agent (rod hardener) such as Al-5% Ti-1% B and Al-10% Ti-1% B.

[0.0005-0.01% B as an Optional Component]

In the present invention, B is preferably contained in the range of 0.0005 to 0.01% for refining crystal grains of an ingot. When B coexists with Ti, B has the effect of producing nuclei (TiBx) which serve as starting points for forming αAl grains in the melt. A more preferred range of the B content is from 0.0005 to 0.005%. B may be added as a master alloy such as Al-5% B or may be added as a grain-refining agent (rod hardener) such as Al-5% Ti-1% B and Al-10% Ti-1% B.

The process for producing an aluminum alloy sheet according to the present invention is not limited to the procedures to be described below. The process includes casting conditions and a final annealing condition, whose significance and reasons for limitation will be described below.

[Casting Conditions of the Thin Slab]

The twin-belt casting process is a continuous casting process in which a melt is poured between two water-cooled rotating belts vertically facing each other and cooled from the belt surfaces to be solidified to form a slab, and the slab is continuously pulled out from the assembly of the belts opposite to the side where the melt is poured and wound into a coil.

In the present invention, the thickness of the slab to be cast is preferably from 5 to 15 mm. If the thickness of the thin slab is less than 5 mm, the amount of aluminum passing through the casting machine per unit time will be too small to cast the slab. Conversely, if the thickness exceeds 15 mm, the slab cannot be wound with a roll. Therefore, the thickness of the slab is limited to the range of 5 to 15 mm. This range of thickness allows a solidification cooling rate at ¼ depth of the thickness of the slab during casting of 20 to 200° C./sec, which allows the control of the intermetallic compounds maximum size to 5 μm or less by circle-equivalent diameter.

[Surface Roughness of the Cold Rolling Roll of 0.2-0.7 μm Ra]

The surface roughness of the cold rolling roll is limited to 0.2-0.7 μm Ra in order to adjust the surface roughness of the finally annealed sheet. Since the shape of the roll surface is transferred to the rolled sheet surface in the cold rolling step, the surface roughness of the finally annealed sheet is 0.2-0.6 μm Ra. When the surface roughness of the finally annealed sheet is in the range of 0.2-0.6 μm Ra, the surface shape of the final sheet will act as a micro pool for uniformly holding a low viscosity lubricating oil used during forming, thus providing a sheet excellent in press formability. Note that the surface roughness of the cold rolling roll is preferably 0.3-0.7 μm Ra, and in this case, the surface roughness of the finally annealed sheet is 0.3-0.6 μm Ra. The surface roughness of the cold rolling roll is more preferably 0.4-0.7 μm Ra, and in this case, the surface roughness of the finally annealed sheet is 0.4-0.6 μm Ra.

[Intermetallic Compound Maximum Size of 5 μm or Less by Circle-Equivalent Diameter]

With respect to the intermetallic compounds in the metallographic structure in the region at ¼ depth of the thickness of the aluminum alloy sheet according to the present invention, the maximum size by circle-equivalent diameter is limited to 5 μm or less. Thus, very fine intermetallic compounds are dispersed in the matrix, so that the movement of dislocation in the aluminum sheet during forming thereof is suppressed to enhance the tensile strength thereof by solid solution strengthening effect by Mg and provide a sheet excellent in formability.

[Average Recrystallized Grain Size of 15 μm or Less]

The average recrystallized grain size in the region at ¼ depth of the thickness of the finally annealed sheet is limited to 15 μm or less. If this is exceeded, the level difference produced in the crystal grain boundaries during the deformation of material will be excessively large, and the orange peel after deformation will be remarkable, thus reducing the resistance to surface roughening.

[The Reason for Limiting the Cold Rolling Reduction to 50-98%]

The rolling reduction during cold rolling is preferably from 50 to 98%. The dislocation generated by the plastic working by rolling is accumulated around the above fine crystallized products. Therefore, the dislocation is necessary to obtain a fine recrystallized structure during final annealing. If the rolling reduction during cold rolling is less than 50%, the accumulation of dislocation will not be enough to obtain a fine recrystallized structure. If the rolling reduction during cold rolling exceeds 98%, edge cracks during rolling will be remarkable, and the yield will be reduced. A more preferred cold rolling reduction is in the range of 55 to 96%.

[Final Annealing Conditions in a Continuous Annealing Furnace]

The temperature of the final annealing in a continuous annealing furnace is limited to 400 to 520° C. If the temperature is less than 400° C., the energy required for recrystallization will be insufficient. Therefore, a fine recrystallized structure cannot be obtained. If the holding temperature exceeds 520° C., the growth of recrystallized grains will be remarkable, and the average recrystallized grain size will exceed 15 μm, resulting in reduction of formability and resistance to surface roughening.

The holding time of the continuous annealing is preferably within 5 minutes. If the holding time of the continuous annealing exceeds 5 minutes, the growth of recrystallized grains will be remarkable, and the average recrystallized grain size will exceed 15 μm, resulting in reduction of formability and resistance to surface roughening.

Regarding the heating rate and cooling rate during the continuous annealing treatment, the heating rate is preferably 100° C./min or more. If the heating rate during the continuous annealing treatment is less than 100° C./min, a fine recrystallized structure will not be obtained and formability and resistance to surface roughening will be reduced.

[Final Annealing Conditions in a Batch Furnace]

The temperature of the final annealing in a batch furnace is limited to 300 to 400° C. If the temperature is less than 300° C., the energy required for recrystallization will be insufficient. Therefore, a fine recrystallized structure cannot be obtained. If the holding temperature exceeds 400° C., the growth of recrystallized grains will be remarkable, and the average size of recrystallized grains will exceed 15 μm, resulting in reduction of formability and resistance to surface roughening.

The holding time of the final annealing in a batch furnace is not particularly limited, but it is preferably 1 to 8 hours. If it is less than 1 hour, the coil may not be uniformly heated. If the holding time exceeds 8 hours, the average size of recrystallized grains will exceed 15 μm, and formability and resistance to surface roughening will be reduced.

[Straightening with a Leveler]

Since the sheet is deformed by thermal strain after the final annealing, it is subjected to straightening such as repetitive bending with a leveler roll in the state of a coil or a sheet to correct the shape and restore the flatness. This straightening enables the sheet to obtain a predetermined tensile strength and yield strength, thus providing an aluminum alloy sheet excellent in formability, resistance to surface roughening and shape fixability.

EXAMPLES

Hereinafter, Examples according to the present invention will be described as compared with Comparative Examples. A melt each having a chemical composition shown in Table 1 (alloy A, B, C, D, E, F, I) was degassed and settled, and the resulting melt was then fed to a twin-belt caster to continuously cast a thin slab having a thickness of 10 mm, which was directly wound into a coil. Similarly, a melt having the chemical composition shown in Table 1 (alloy G) was degassed and settled, and the resulting melt was then subjected to DC casting process to cast a slab of 1000 mm (width)×500 mm (thickness)×4000 mm (length). The slab was subjected to face milling of both surfaces thereof and then subjected to homogenization of 450° C.×8 hours in a soaking furnace followed by hot rolling to produce a hot-rolled sheet having a thickness of 6 mm, which was wound into a coil. Similarly, a melt having the chemical composition shown in Table 1 (alloy H) was degassed and settled, and the resulting melt was then fed to a twin-belt caster to continuously cast a thin slab having a thickness of 6 mm, which was directly wound into a coil.

TABLE 1

Chemical composition of alloy

| Alloy symbol | Composition (mass %) | | | |
|---|---|---|---|---|
| | Mg | Mn | Fe | Si |
| A | 3.35 | 0.00 | 0.2 | 0.08 |
| B | 3.25 | 0.06 | 0.2 | 0.08 |
| C | 3.75 | 0.05 | 0.2 | 0.08 |
| D | 2.50 | 0.07 | 0.2 | 0.08 |
| E | 3.45 | 0.20 | 0.2 | 0.08 |
| F | 4.00 | 0.30 | 0.2 | 0.08 |
| G | 3.35 | 0.00 | 0.2 | 0.08 |
| H | 3.35 | 0.00 | 0.2 | 0.08 |
| I | 3.25 | 0.06 | 0.2 | 0.08 |

Next, these thin slabs and the hot rolled sheets were cold rolled with cold rolling rolls which were finished to a predetermined surface roughness (0.6 μm, 1.0 μm Ra) to form sheets having a thickness of 1 mm. Then, these sheets were passed through a CAL to undergo continuous annealing at a holding temperature of 460° C. Further, the finally annealed sheets were passed through a leveler to undergo straightening to remove thermal strain therefrom followed by cutting to obtain test specimens. Note that Table 2 shows production conditions of the test specimens in each production step in Examples and Comparative Examples.

TABLE 2

Production conditions

| | Alloy symbol | Casting process/ thickness (mm) | Cooling rate (° C./s) | Hot rolling | Cold rolling roll surface roughness Ra (μm) | Thickness (mm) | Annealing temperature |
|---|---|---|---|---|---|---|---|
| Example 1 | A | Twin belt/10 | 100 | None | 0.6 | 1.0 | 460° C. |
| Example 2 | B | Twin belt/10 | 78 | None | 0.6 | 1.0 | 460° C. |
| Comparative Example 1 | C | Twin belt/10 | 85 | None | 0.6 | 1.0 | 460° C. |
| Comparative Example 2 | D | Twin belt/10 | 75 | None | 0.6 | 1.0 | 460° C. |

TABLE 2-continued

| Production conditions | | | | | | | |
|---|---|---|---|---|---|---|---|
| | Alloy symbol | Casting process/ thickness (mm) | Cooling rate (° C./s) | Hot rolling | Cold rolling roll surface roughness Ra (μm) | Thickness (mm) | Annealing temperature |
| Comparative Example 3 | E | Twin belt/10 | 76 | None | 0.6 | 1.0 | 460° C. |
| Comparative Example 4 | F | Twin belt/10 | 74 | None | 0.6 | 1.0 | 460° C. |
| Comparative Example 5 | G | DC/500 | 3 | 6 mm | 0.6 | 1.0 | 460° C. |
| Comparative Example 6 | H | Twin roll/6 | 300 | None | 0.6 | 1.0 | 460° C. |
| Comparative Example 7 | I | Twin belt/10 | 78 | None | 1.0 | 1.0 | 460° C. |

Next, these test specimens were evaluated for the recrystallized grain size, the intermetallic compound maximum size by circle-equivalent diameter, surface roughness, 0.2% yield strength (0.2% YS), tensile strength (UTS), elongation (EL), and punch stretch height.

The recrystallized grain size (D) of a test specimen was measured by an cross-cut method. The test specimen was cut, embedded in a resin, polished, and subjected to anodic coating in an aqueous fluoroboric acid solution to apply an anodic oxide film to the surface of the section of the test specimen. A photograph (200 times) of grains in the section of the test specimen was taken with a polarizing microscope. On the photograph, three lines were drawn both in the vertical direction and in the horizontal direction. The number (n) of crystal grain boundaries crossing these lines was counted. The average value (D) of the grain sizes determined by dividing the total length (L) of the lines by (n−1) was defined as the average recrystallized grain size of the test specimen. The intermetallic compound maximum size by circle-equivalent diameter was measured with an image analyzer (trade name: LUZEX).

$$D=L/(n-1)$$

The surface roughness of the test specimen was measured using a surface roughness meter according to JIS B0601, wherein the direction of measurement was perpendicular to the rolling direction; the measurement region was 4 mm; and the cutoff was 0.8 mm. The resulting surface roughness was defined as the average roughness Ra. Note that surface roughness of the roll was measured in the same manner as in the measurement of the surface roughness of the test specimen using a surface roughness meter according to JIS B0601, wherein the direction of measurement was in the transverse direction of the roll; the measurement region was 4 mm; and the cutoff was 0.8 mm. The resulting surface roughness was defined as the average roughness Ra.

The punch stretch height was measured using the following die assembly and indicates the critical forming height at break. (Punch: 100 mm in diameter, shoulder R: 50 mm, die: 105 mm in diameter, shoulder R: 4 mm)

The resistance to surface roughening was evaluated at three stages (○: excellent, Δ: a little poor, X: poor) by visually observing the surface condition near the broken part of the test piece after the tensile test.

The results of Examples and Comparative Examples measured as described above are shown in Table 3.

TABLE 3

| Evaluation results of properties | | | | | | | | |
|---|---|---|---|---|---|---|---|---|
| | Average size of recrystallized grains (μm) | Maximum size of crystallized products (μm) | Surface roughness Ra (μm) | YS (Mpa) | UTS (Mpa) | EL (%) | Punch stretch height (mm) | Evaluation of resistance to surface roughening |
| Example 1 | 12 | 3.7 | 0.35 | 133 | 234 | 28 | 30 | ○ |
| Example 2 | 11 | 3.5 | 0.41 | 134 | 233 | 27 | 30 | ○ |
| Comparative Example 1 | 10 | 4 | 0.37 | 146 | 248 | 27 | 29 | ○ |
| Comparative Example 2 | 11 | 4.2 | 0.42 | 121 | 209 | 26 | 30 | ○ |
| Comparative Example 3 | 9 | 4.1 | 0.39 | 148 | 244 | 27 | 29 | ○ |
| Comparative Example 4 | 8 | 4.5 | 0.38 | 155 | 265 | 27 | 28 | ○ |
| Comparative Example 5 | 25 | 15 | 0.45 | 120 | 224 | 28 | 27 | Δ |
| Comparative Example 6 | 54 | 2 | 0.35 | 115 | 222 | 26 | 26 | X |
| Comparative Example 7 | 13 | 3.7 | 0.80 | 132 | 232 | 28 | 28 | ○ |

In Examples 1 and 2, the Mg content is proper, and in addition, the Mn content is suppressed to less than 0.1%. As a result, the test specimens in Examples 1 and 2 are excellent in shape fixability since they have a yield strength of 145 MPa or less; they are excellent in resistance to surface roughening since they have fine recrystallized grains; and they are excellent in formability to an extent of a punch stretch height of 29 mm or more since they have fine intermetallic compounds and have a proper surface roughness of 0.35 and 0.41 μm, respectively.

On the other hand, in Comparative Example 1, since the Mg content is as high as 3.75%, the 0.2% yield strength is excessively increased to result in reduction of shape fixability. In Comparative Example 2, since the Mg content is as low as 2.5%, both the tensile strength and elongation are insufficient.

In Comparative Example 3, the Mg content is proper, but the Mn content is as high as 0.2%. As a result, the 0.2% yield strength is excessively increased to result in reduction of shape fixability.

In Comparative Example 4, since the Mg content and the Mn content are as high as 4.0% and 0.3%, respectively, the 0.2% yield strength is excessively increased to result in reduction of shape fixability.

In Comparative Example 5, since the solidification cooling rate during the slab casting by a DC casting process is low, the maximum size of the intermetallic compounds is excessively large, and the recrystallized grain size is also excessively large. As a result, the tensile strength is reduced, and the resistance to surface roughening and punch stretch formability are also reduced.

In Comparative Example 6, since the solidification cooling rate of the cast rolled sheet by a twin-roll process is high, the number of the intermetallic compounds which serve as the nuclei of recrystallized grains during the final annealing is insufficient, and the number of the intermetallic compounds having so-called pinning effect that prevents the motion of the grain boundaries of recrystallized grains is also insufficient, thereby excessively increasing the size of the recrystallized grains. As a result, the tensile strength and elongation are insufficient, and the resistance to surface roughening and punch stretch formability are reduced.

In Comparative Examples 7, the cold rolling roll has a surface roughness of 1.0 μm Ra, and the test specimen has a surface roughness of 0.8 μm Ra. As a result, the punch stretch height is 28 mm, indicating a reduced formability.

The invention claimed is:

1. A process for producing a sheet of an aluminum alloy for motor vehicles, the process comprising:

casting a melt of the aluminum alloy comprising 3.0-3.35 mass % Mg, 0.05-0.3 mass % Fe, 0.05-0.15 mass % Si, 0.001-0.1% mass % Ti, 0.0005-0.01% B, further a limited amount of less than 0.08 mass % Mn, and a balance substantially being inevitable impurities and Al, into a thin slab having a thickness of 5 to 15 mm in a twin-belt caster so that the cooling rate at ¼ depth of a thickness of the thin slab is 20 to 200 degree Celsius/sec;

winding the cast thin slab into a coiled thin slab;

subjecting the coiled thin slab to cold rolling with a roll having a surface roughness of 0.2 to 0.7 micro-meters Ra at a cold rolling reduction of 50 to 98% to produce a cold rolled thin sheet;

subjecting the cold rolled thin sheet to final annealing continuously in a CAL at a holding temperature of 400 to 520 degree Celsius within 5 minutes; and subjecting the resulting sheet to straightening with a leveler, producing the aluminum alloy sheet having an intermetallic compound maximum size of 5 micro-meters or less by circle-equivalent diameter in a region at ¼ depth of the sheet thickness, an average recrystallized grain size of 11-15 micro-meters, a surface roughness of 0.2 to 0.6 micro-meters Ra, and a yield strength of 134-145 MPa.

2. The process for producing an aluminum alloy sheet for motor vehicles, according to claim 1, wherein the amount of Mn is limited to less than 0.06 mass %.

3. A process for producing a sheet of an aluminum alloy for motor vehicles, the process comprising:

casting a melt of the aluminum alloy comprising 3.0-3.35 mass % Mg, 0.05-0.3 mass % Fe, 0.05-0.15 mass % Si, 0.001-0.1% mass % Ti, 0.0005-0.01% B, further a limited amount of less than 0.08 mass % Mn, and a balance substantially being inevitable impurities and Al, into a thin slab having a thickness of 5 to 15 mm in a twin-belt caster so that the cooling rate at ¼ depth of a thickness of the thin slab is 20 to 200 degree Celsius/sec;

winding the cast thin slab into a coiled thin slab; subjecting the coiled thin slab to cold rolling with a roll having a surface roughness of 0.2 to 0.7 micro-meter Ra at a cold rolling reduction of 50 to 98% to produce a cold rolled thin sheet;

subjecting the cold rolled thin sheet to final annealing in a batch annealing furnace at a holding temperature of 300 to 400 degree Celsius for 1 to 8 hours; and subjecting the resulting sheet to straightening with a leveler, producing the aluminum alloy sheet having an intermetallic compound maximum size of 5 micro-meters or less by circle-equivalent diameter in a region at ¼ depth of the sheet thickness, an average recrystallized grain size of 11-15 micro-meters, a surface roughness of 0.2 to 0.6 micro-meter Ra, and a yield strength of 134-145 MPa.

4. The process for producing an aluminum alloy sheet for motor vehicles, according to claim 3, wherein the amount of Mn is limited to less than 0.06 mass %.

* * * * *